US005478987A

United States Patent [19]

Morita

[11] Patent Number: 5,478,987

[45] Date of Patent: Dec. 26, 1995

[54] HIGH-FREQUENCY HEATING APPARATUS WITH ALCOHOL SENSOR

[75] Inventor: Mika Morita, Nagoya, Japan

[73] Assignee: Kabushiki Kaisha Toshiba, Kawasaki, Japan

[21] Appl. No.: 297,989

[22] Filed: Aug. 30, 1994

[30] Foreign Application Priority Data

Aug. 30, 1993 [JP] Japan ..... 5-214184

[51] Int. Cl.[6] ..... H05B 6/80

[52] U.S. Cl. ..... 219/705; 219/707; 99/325

[58] Field of Search ..... 219/707, 705, 219/704, 492; 99/325

[56] References Cited

U.S. PATENT DOCUMENTS 4,874,928 10/1989 Kasai ..... 219/492
5,352,867 10/1994 Shota ..... 219/707
5,360,965 11/1994 Ishii et al. ..... 219/705
5,367,145 11/1994 Takagi ..... 219/705

FOREIGN PATENT DOCUMENTS 0586231 3/1994 European Pat. Off. .
2269029 1/1994 United Kingdom .

*Primary Examiner*—Philip H. Leung
*Attorney, Agent, or Firm*—Cushman Darby & Cushman

[57] ABSTRACT

A microwave oven includes a control circuit provided for properly heating food on the basis of detection by an alcohol sensor. Upon depression of a beverage key of an operation panel, the control circuit detects change rates of signals generated by the alcohol sensor before the heating operation and during the heating operation. When the change rates exceed respective reference values, beverage to be heated is determined to be Japanese saké. When the determination before the heating operation does not coincide with that during the heating operation, the control circuit determines which the beverage is, the saké or the milk or the other type of beverage, on the basis of the determination both before and during the heating operation, setting a driving period of time of a magnetron accordingly.

8 Claims, 5 Drawing Sheets

HIGH-FREQUENCY HEATING APPARATUS WITH ALCOHOL SENSOR

BACKGROUND OF THE INVENTION

1. Field of the Invention

This invention relates to a heating apparatus such as microwave ovens in which food accommodated in a heating chamber is grouped into a first food group in which food contains a large volume of alcoholic component or a second food group in which food contains a small volume of alcoholic component and heating means is driven for a period of time in accordance with the grouped food group.

2. Description of the Prior Art

In conventional microwave ovens with an automatic cooking function, for example, it is determined whether a beverage to be heated is milk or Japanese saké which will hereinafter be referred to as "saké" when the beverage is warmed. A driving period of time of a magnetron is set on the basis of the result of determination. This manner of setting depends upon the difference of alcoholic concentration between the saké or milk. The alcoholic concentration is detected during a heating operation so that the food is determined to be sak+e,acu +ee or milk. A target temperature in heating the saké is normally set to be lower than one of the milk. When the weight of the saké is the same as that of the milk, a heating period of time of the saké is set to be lower than one of the milk. Accordingly, the time the presence or absence of alcohol is determined is set to be a time before the heating time period of the saké expires.

The presence or absence of alcohol is determined on the basis that a change rate of the alcoholic concentration in the heating chamber has reached a reference value at the above-mentioned time or a determination time. When the food to be heating is determined to be the saké at the determination time, a magnetron is driven until the heating time period of the saké expires. When the food cannot be determined to be the saké, the food is determined to be the milk and the magnetron is driven until the heating time period of the milk expires. Consequently, the food can be heated to a suitable temperature on the basis of the determination as to presence or absence of alcohol.

In the above-described prior art arrangement, however, presence or absence of alcohol in the beverage to be heated is determined only at one time during the heating operation. Accordingly, there is a possibility that an erroneous determination may result from the temperature in the heating chamber, the condition where the food has been stored in a refrigerator or the like, or the type of a receptacle containing the beverage such as the size of an opening of the receptacle through which the beverage is poured into and out of it. Since there are two kinds of foods in this case, that is, the saké and milk, the saké is excessively heating or the milk is insufficiently heated upon occurrence of the erroneous determination.

SUMMARY OF THE INVENTION

Therefore, an object of the present invention is to provide a high frequency heating apparatus wherein the type of the food can be determined on the basis of alcoholic content thereof with a high level of reliability so that a suitable heating time period can be provided in accordance with the determined type of the food.

The present invention provides an improved high frequency heating apparatus comprising a heating chamber, heating means for heating food accommodated in the heating chamber, an alcohol sensor detecting alcoholic concentration in the heating chamber, thereby generating a detection signal, food determining means connected to the alcohol sensor for performing a determining operation wherein the food accommodated in the heating chamber is grouped into a first food group in which food contains a large volume of alcoholic component or a second food group in which food contains a small volume of alcoholic component, on the basis of the alcoholic concentration detected by the alcohol sensor, and control means connected to the heating means and the food determining means for driving the heating means for a period of time in accordance with the food group into which the food accommodated in the heating chamber has been grouped, wherein the food determining means comprises first grouping means executing the grouping of the food into the first or second food group on the basis of the detection signal from the alcohol sensor after generation of a cooking start command and before initiation of drive of the heating means and thereby obtaining provisional grouping results, second grouping means executing the grouping of the food into the first or second food group on the basis of the detection signal from the alcohol sensor during drive of the heating means subsequent to the grouping operation of the first grouping means, and difference determining means delivering a command to the control means so that a heating period of time is rendered longer than one for food of the first food group and shorter than one for food of the second food group, when the results of the grouping by the first and second grouping means differ from each other.

According to the above-described high-frequency heating apparatus, the first grouping means groups the food accommodated in the heating chamber into the first food group in which food contains a large volume of alcoholic component or a second food group in which food contains a small volume of alcoholic component. Subsequently, the second grouping means groups the food into the first or second food group. On the basis of these determining operations, the food is finally specified into one of the food groups.

Additionally, the heating period of time is rendered longer than the one for food of the first food group and shorter than the one for food of the second food group, when the results of the grouping by the first and second grouping means differ from each other.

The above-described arrangement is directed to occurrence of an abnormal condition where the food cannot be grouped into the first nor second food group. In this case, since the second food determining operation during drive of the heating means has high reliability, there is a high probability that the food can be grouped into the second food group. However, since the food has been determined to be grouped into the first food group by the first food determining operation before drive of the heating means, the heating time period is set at an intermediate value between those of the first and second food groups. Consequently, an excessive heating can be prevented in case that the food actually belongs to the first food group.

In a second preferred form, the heating apparatus further comprises receptacle detecting means for detecting a type of receptacle containing the food in the heating chamber. The food determining means groups the food on the basis or a signal generated by the receptacle detecting means. Since the receptacle is directly detected in the above-described arrangement, determination of the type of food has an exceedingly high level of reliability. Consequently, the food determining operation is executed only when the receptacle cannot be determined by the receptacle detecting means, which can avoid useless execution of the food determining operation.

BRIEF DESCRIPTION OF THE DRAWINGS

Other objects, features and advantages of the present invention will become clear upon reviewing the following description of preferred embodiment thereof, made with reference to the accompanying drawings, in which.

DESCRIPTION OF THE PREFERRED EMBODIMENT

Figure 2:
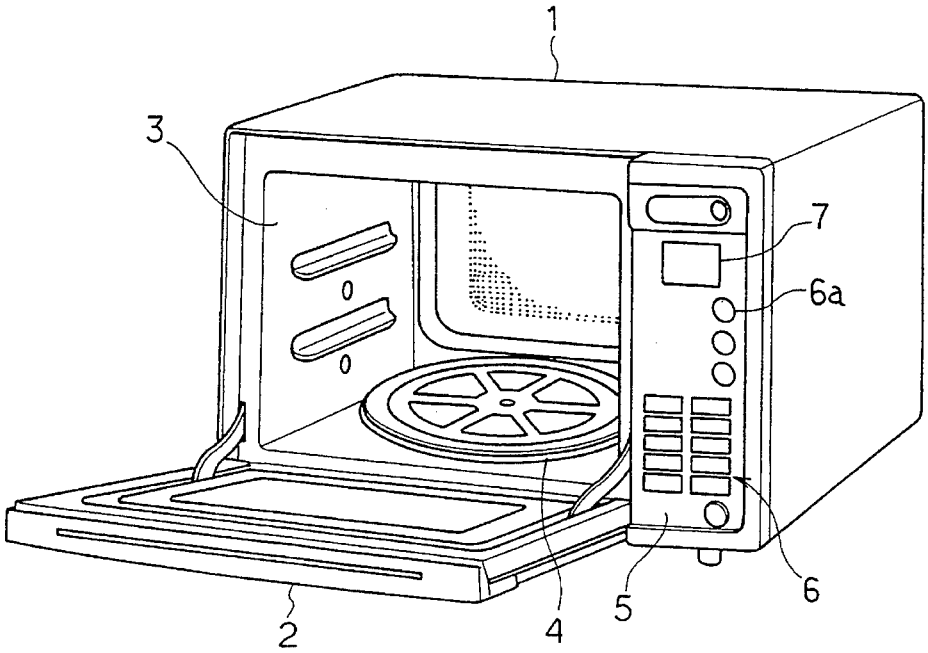
FIG. 2 is a perspective view of the microwave oven.

One embodiment of the present invention will be described with reference to the accompanying drawings. In the embodiment, the invention is applied to a microwave oven with oven and grill functions. Referring to FIG. 2, a microwave oven 1 has a heating chamber 3 closed by a door 2. A turntable 4 is rotatably mounted on the bottom of the heating chamber 3. An operation panel 5 is mounted on the front of the microwave oven 1. The operation panel 5 includes an operation section 6 comprising a plurality of keys and a display section 7. The operation section 6 includes a beverage key 6*a* for exclusive use. The beverage key 6*a* is operated when saké and milk are heated.

Figure 3:
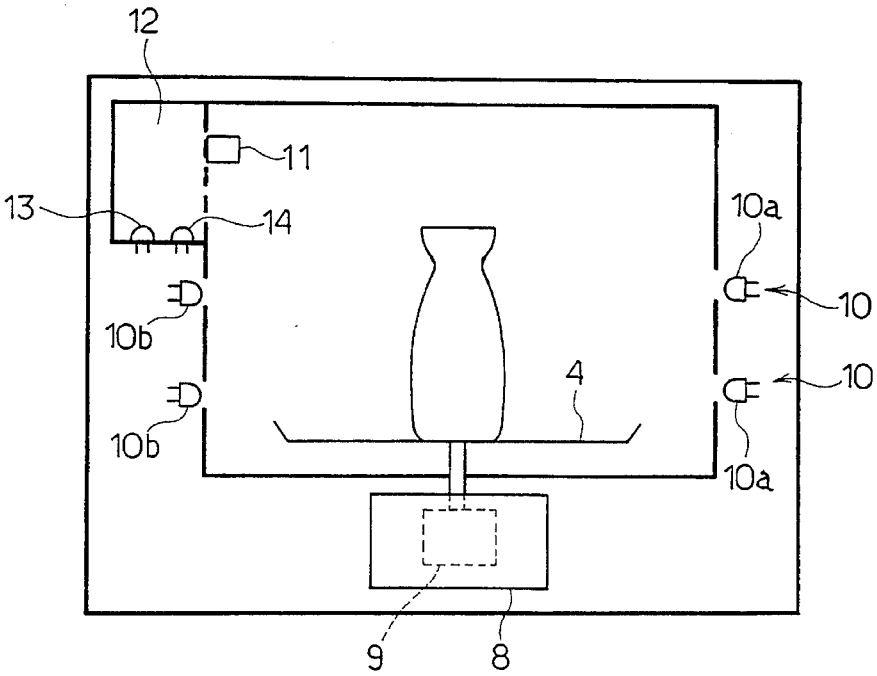
FIG. 3 is a diagrammatic view of the microwave oven showing the arrangement of sensors.

Referring now to FIG. 3, the turntable 4 is turned by a drive mechanism 8. The load applied to the turntable 4 is received by a weight sensor 9 provided in the drive mechanism 8. Two photo sensors 10 each serving as receptacle detecting means are provided to be vertically aligned on opposite side walls of the heating chamber 3. Each photo sensor 10 comprises a light emitting element 10*a* mounted on one of the opposite side walls of the heating chamber 3 and a light detecting element 10*b* mounted on the other side wall. The upper photo sensor 10 is located over the turntable 4 by 100 millimeters. A temperature sensor 11 is provided in the heating chamber 3. An alcohol sensor 13 and a gas sensor 14 are provided in an exhaust path 12 communicating with the heating chamber 3.

Figure 1:
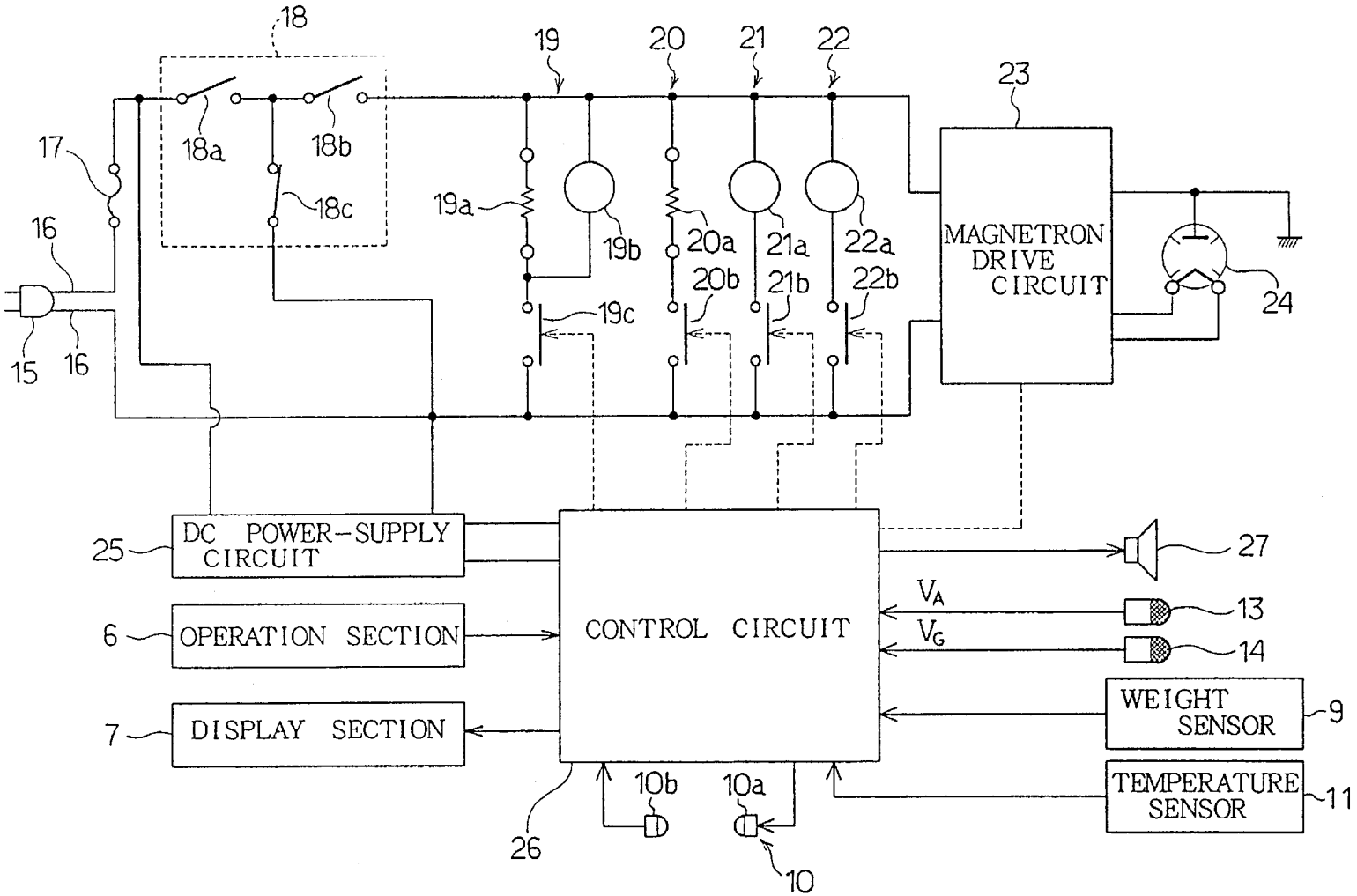
FIG. 1 is a schematic circuit diagram showing an electrical arrangement of one embodiment of a microwave oven in accordance with the present invention.

Referring now to FIG. 1, a fuse 17 and an oscillation shutdown device 18 are connected to one of AC power-supply lines 16 extending from a power-supply plug 15. The oscillation shutdown device 18 comprises first to third door switches 18*a* and 18*c*. When the heating chamber 3 is closed by the door 2, the first and second door switches 18*a*, 18*b* are turned on while the third door switch 18*c* is turned off.

An oven control circuit 19, a grill control circuit 20, a blowing control circuit 21 and a turntable control circuit 22 are connected between the AC power-supply lines 16. The oven control circuit 19 comprises a parallel circuit of an oven heater 19*a* and an oven fan 19*b* and an oven relay switch 19*c* connected in series to the parallel circuit. The grill control circuit 20 comprises a series circuit of a grill heater 20*a* and a grill relay switch 20*b*. The blowing control circuit 21 comprises a series circuit of a blowing fan 21*a* and a blowing relay switch 21*b*. The turntable control circuit 22 comprises a series circuit of a turntable motor 22*a* composing the above-mentioned drive mechanism 8 and a motor relay switch 22*b*.

A magnetron drive circuit 23 is connected to the AC power-supply lines 16 for supplying a high voltage to a magnetron 24 serving as heating means. The magnetron 24 radiates microwaves through a waveguide (not shown) into the heating chamber 3.

A DC power-supply circuit 25 is connected to the AC power-supply line 16 for supplying a DC voltage to a control circuit 26 serving as control means and comprising a microcomputer. Each key of the operation section 6 generates an output signal when operated. The output signal generated by each key is supplied to the control circuit 26. The display section 7 displays the contents in accordance with a display command supplied thereto from the control circuit 26. A buzzer 27 is activated in response to a command supplied thereto from the control circuit 26. The alcohol sensor 13 generally detects alcohol contained in exhaust gas exhausted from the heating chamber 3. The gas sensor 14 generally detects steam contained in the exhaust gas from the heating chamber 3. Each of these sensors 13, 14 varies its resistance value in accordance with concentration of the gas to be detected and delivers to the control circuit 26 a voltage signal indicative of the varied resistance value. The weight sensor 9 detects the weight of food placed on the turntable 4 and delivers to the control circuit 26 a signal indicative of the detected weight of the food. The temperature sensor 11 detects the temperature in the heating chamber and delivers to the control circuit 26 a signal indicative of the detected temperature. The control circuit 26 turns the relay switches 19*c*, 20*b*, 21*b* and 22 *b* on and off in suitable timing and drive the magnetron drives circuit 23 depending upon one or more operated keys of the operation section 6, thereby executing a heating operation. The control circuit 26 completes the heating operation upon lapse of a heating period of time or in response to detection by the sensor 9, 11, 13 and 14.

Figure 4A:
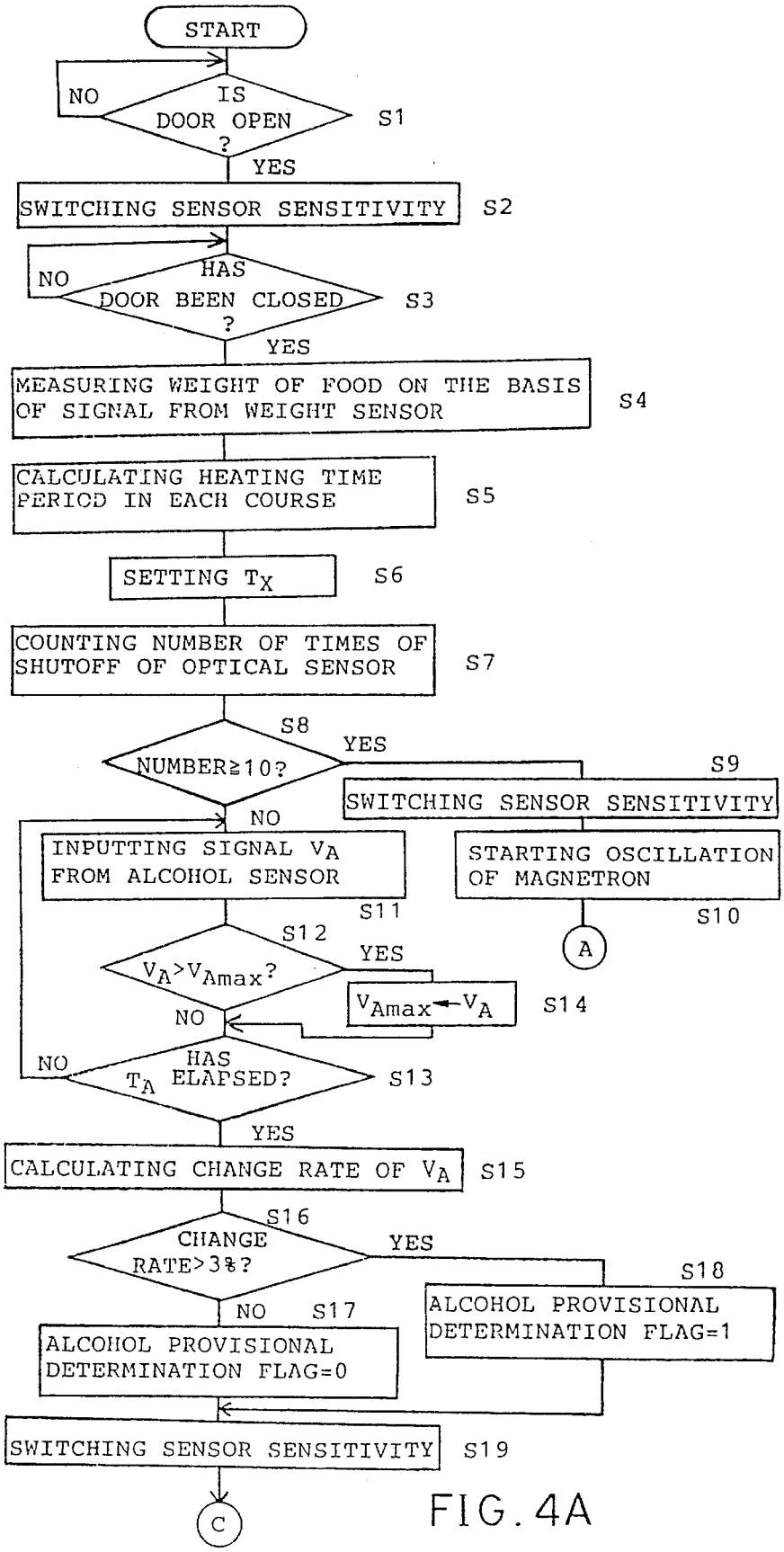
FIGS. 4A and 4B are flowcharts showing operation of a control circuit employed in the microwave oven.
Figure 4B:
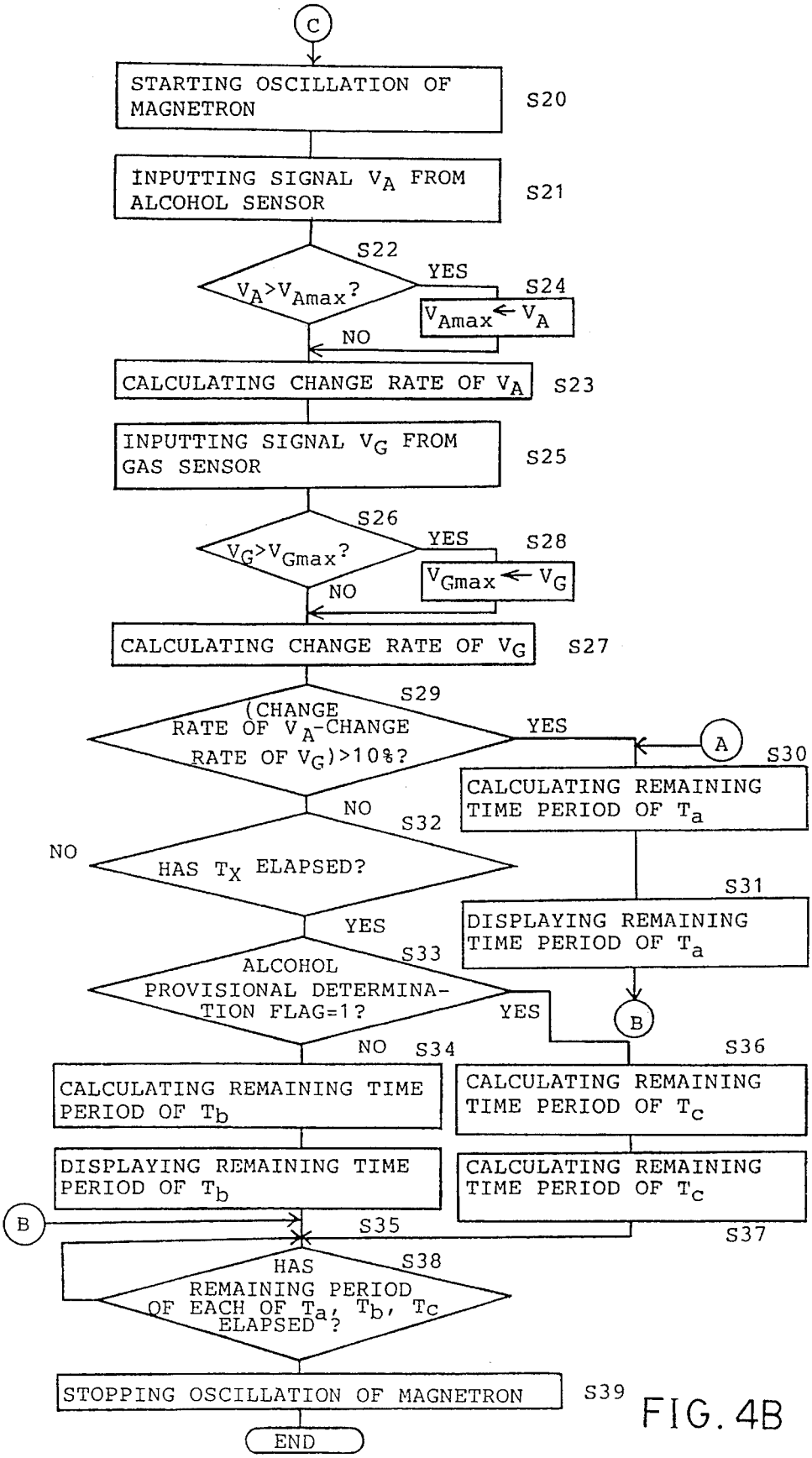
Figure 5:
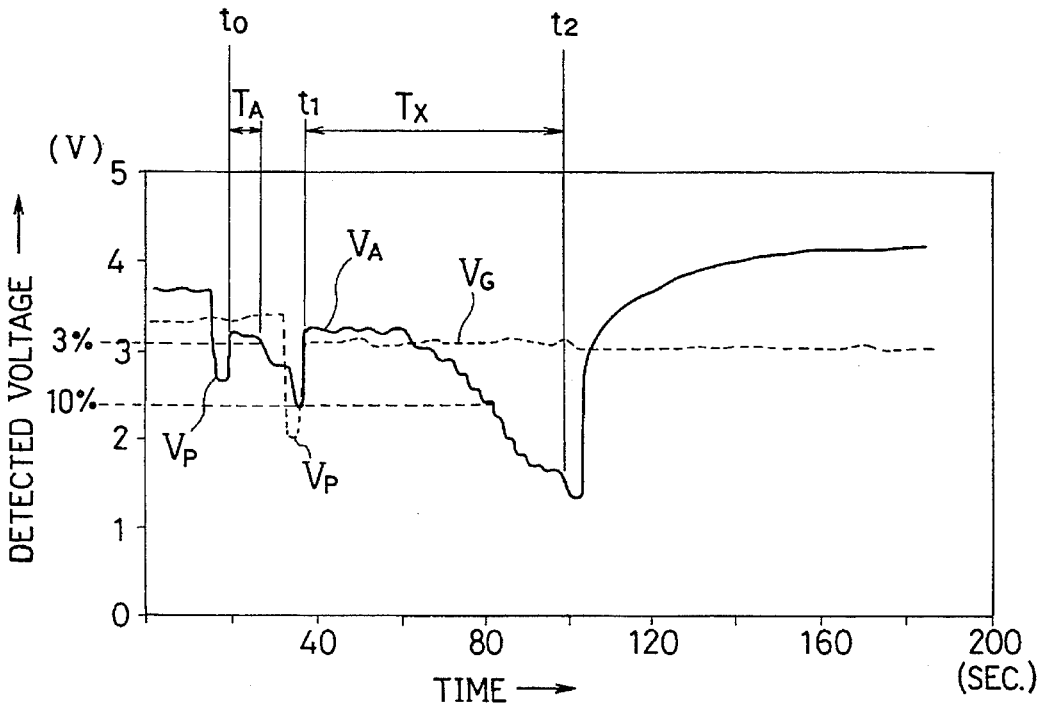
FIG. 5 is a graph showing changes in signals from sensors detecting alcohol and steam respectively in the case where the food is determined to be saké.
Figure 6:
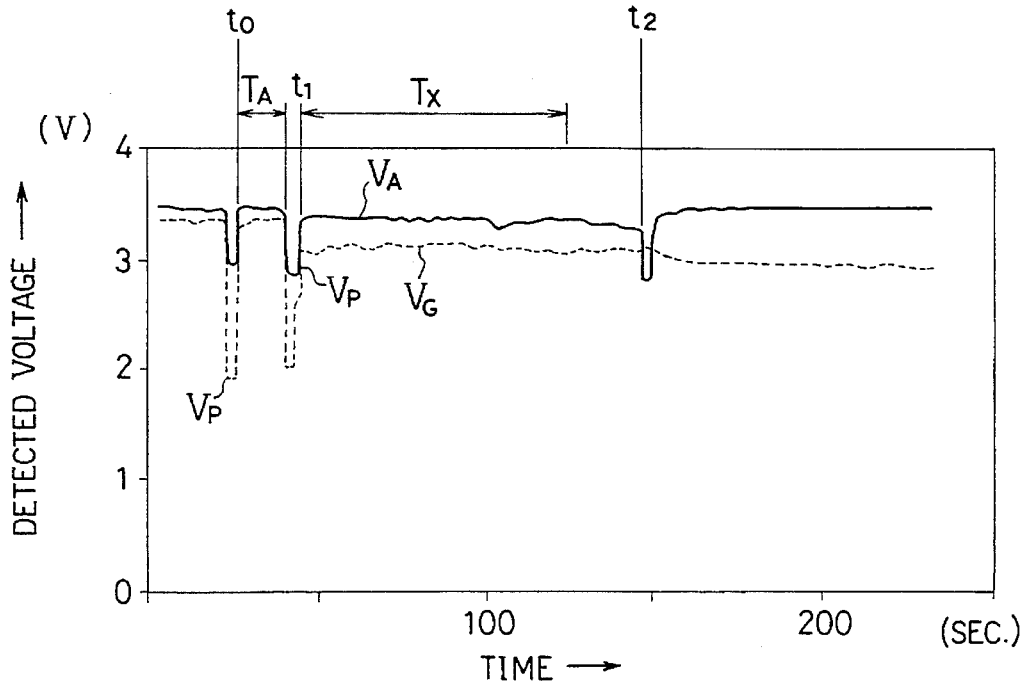
FIG. 6 is a graph showing changes in signals from sensors detecting alcohol and steam respectively in the case where the food is determined to be milk.

The operation of the microwave oven will now be described with reference to FIGS. 4A, 4B, 5 and 6. FIG. 5 shows the variations of a signal $V_A$ generated by the alcohol sensor 13 and a signal $V_G$ generated by the gas sensor 14, with lapse of time when the beverage to be heated is saké belonging to a first food group. FIG. 6 shows the variations of these signals when the beverage to be heated is milk belonging to a second food group. FIGS. 4A and 4B show the operation of the control circuit 26 in the case where the beverage key 6*a* of the operation section 6 is operated. The control circuit 26 switches the sensitivity of the alcohol and gas sensors 13, 14 to respective optimum values when the door 2 has been opened (steps S1 and S2). More specifically, a plurality of exterior resistors (not shown) having resistance values different from one another are connected to output lines of the respective sensor 13, 14. The microcomputer incorporated in the control circuit 26 automatically selects an optimum exterior resistor with respect to each of the sensors 13, 14 so that an output level (output voltage) falls within the range suitable for the determination of food. Reference symbol $V_p$ in each of FIGS. 5 and 6 designates a transient change of voltage due to the above-described sensitivity adjustment.

The weight of the beverage to be heated is measured by the weight sensor 9 (step S4) when the door 2 is closed with a receptacle being placed on the turntable 4 (step S3). Based on the measured weight, the control circuit 26 calculates a heating time period T of each of saké, milk and intermediate courses (step S5). That is, the heating time period of a saké course is obtained from an equation, $T_a$=0.121W+18 (sec.) where W is the weight of the beverage to be heated. The heating time period of a milk course is obtained from an equation, $T_b$=0.206W+18 (sec.). The heating time period of an intermediate course is obtained from an equation, $T_c$–0.164W+18 (sec.).

The control circuit 26 then sets the heating time period $T_a$ of the saké course, which period is the shortest of the three, as a reference time period $T_X$ for the determination of food (step S6). The reference time period $T_X$ refers to the length of time starting at time $t_1$ when the heating operation is initiated (see FIG. 5). The heating time period of the saké course is employed as the reference time period $T_X$ for the following reason. When the beverage to be heated is the saké, the determination as to presence or absence of alcohol needs to be completed until the heating time period of the saké elapses. The reference time period $T_X$ may be set for a predetermined period within the heating time period $T_a$ of the saké course. However, the increase in the temperature of the beverage and accordingly, exhalation of alcohol have been most advanced at the time of expiration of the eating time period of the saké course. Accordingly, since the determination as to presence or absence of alcohol is easy and accurate that the time of expiration of the heating time period of the saké course, it is preferable to set the heating time period $T_a$ of the saké course as the reference time period $T_X$.

The control circuit 26 then counts the number of times of shutoff of each photo sensor 10 for every one turn of the turntable 4 (step S7) to determine the type of the receptacle on the basis of the counted number (step S8). In step S8, the light-emitting element 10*a* of each photo sensor 10 emits light 600 times while the turntable 4 is turned by one turn. The number of times of non-detection of light by each light detecting element 10*b* or the number of times of shutoff of each photo sensor 10 is counted. When the number of times of shutoff of each photo sensor 10 is 10 or above, the control circuit 26 assumes the number as a receptacle detection output. Consequently, on the basis of the output of each photo sensor 10, it is determined that the receptacle placed on the turntable 4 is either a high saké bottle called "tokkuri" in Japanese or a low cup or that nothing is placed on the turntable 4. The "tokkuri" is usually employed when the saké is warmed. To prevent an erroneous detection due to influences of noise, the number of times of shutoff of each photo sensor 10 for the determination of type of the receptacle is set for as many as 10 or above.

When determining that the receptacle is a saké bottle, the control circuit 26 switches the sensitivity of each sensor to a low level in the manner same as described above and causes the magnetron 24 to oscillate, thereby executing the heating operation in the saké course (steps S9 and S10). Time $t_1$ in each of FIGS. 5 and 6 is a time when the operation of the magnetron 24 is initiated or the heating to the food is initiated.

When determining that the receptacle is not a saké bottle, the control circuit 26 executes the determination of food prior to the heating operation. This determination will be referred to as a first food determining operation. Describing the first food determining operation, when answering in the negative at step S8, the control circuit 26 continuously inputs the signal $V_A$ from the alcohol sensor 13 for a predetermined time period $T_A$ starting at time $T_0$, for example, for 13 seconds (step S11), so that a maximum value $V_{Amax}$ of the signal $V_A$ is the period of 13 seconds is detected (steps S12, S13 and S14). The control circuit 26 then calculates a rate of change of the signal $V_A$ with respect to the maximum value $V_{Amax}$ at the time of lapse of 13 seconds, $(V_{Amax}-V_A)/V_{Amax}\cdot 100$ (%) step S15). The control circuit 26 then determines whether the obtained change rate of the signal $V_A$ is equal to or above 3% which is a reference value for determination of an alcoholic food. Based on the determination, the control circuit 26 further determines that the beverage to be heated is saké grouped into the first group of food containing a large volume of alcoholic component of milk grouped into the second group of food containing a small volume of alcoholic component (step S16). When the beverage to be heated is determined to be the saké, an alcohol provisional determination flag is set at 0 (step S17). When the beverage is determined to be the milk, the flag is set at 1 (step S18).

Referring to FIGS. 5 and 6, in the case where the saké is to be heated, alcohol exhales from the saké even when the temperature in the heating chamber 3 is equal to the room temperature. Accordingly, the signal $V_A$ generated by the alcohol sensor 13 changes more than 3% within the predetermined time period $T_A$. Furthermore, since the degree of generation of steam from the saké is low, the signal $V_G$ generated by the has sensor 14 scarcely changes. On the other hand, in the case where the milk is to be heated, neither alcohol nor steam exhales from the milk at the room temperature. Accordingly, the signals $V_A$ and $V_G$ generated by the respective sensors 13 and 14 scarcely change before the heating. Consequently, in the first food determining operation, the beverage to be heated can be preliminarily determined to be saké or milk before the heating on the basis of the determination as to whether or not the change rate of the signal $V_A$ generated by the alcohol sensor 13 has changed 3% or more. Thus, after preliminarily grouping the beverage in the first food determining operation at steps S17 and S18, the control circuit 26 reswitches the sensitivity of the sensors 13 and 14 at respective optimum values (step S19).

Subsequently, the control circuit 26 drives the magnetron drive circuit 13 to thereby initiate oscillation of the magnetron 24 (at time $t_1$ in step S20). Microwaves from the magnetron 24 are radiated into the heating chamber 3 so that the beverage in the receptacle is heated. Since alcohol exhales from the beverage when it is the saké, the signal $V_A$ generated by the alcohol sensor 13 drops to a large extent as shown by solid line in FIG. 5. On the other hand, when the beverage to be heated is the milk, the signal $V_A$ generated by the alcohol sensor 13 scarcely varies as shown by solid line FIG. 6.

The control circuit 26 inputs the signal $V_A$ from the alcohol sensor 13 (step S21) and calculates the change rate of the signal, $(V_{Amax}-V_A)/V_{Amax}\cdot 100$ (%) (steps S22–S24). In this case, when the input signal $V_A$ is larger than the current maximum signal $V_{Amax}$, the input signal $V_A$ is substituted from the current maximum signal $V_{Amax}$ (steps S22 and S24). Furthermore, the control circuit 26 inputs the signal $V_G$ from the gas sensor 14 (step S25) and calculates the change rate of the signal, $(V_{Gmax}-V_G)/V_{Gmax}\cdot 100$ (%) (steps S26–S28). In this case, when the input signal $V_G$ is larger than the current maximum signal $V_{Gmax}$, the input signal $V_G$ is substituted for the current maximum signal $V_{Gmax}$ (steps S26 and S28).

The control circuit 26 then determines whether or not the difference obtained by subtracting the change rate of the signal $V_G$ from the change rate of the signal $V_A$ is equal to or above 10% as a reference for the determination of alcoholic food (step S29). Stem exhales from the saké as well as alcohol and the alcohol sensor 13 has the characteristic of detecting the steam as well as the alcohol. The above-mentioned subtraction is for prevention of influence of steam upon detection of alcohol.

Referring further to FIGS. 5 and 6, when the beverage to be heated is the saké, the difference obtained by subtracting the change rate of the signal $V_G$ from that of the signal $V_A$ exceeds 10% within the reference time period $T_X$ which is equal to the heating time period $T_a$ of the saké in the embodiment. On the other hand, when the beverage to be heated is the milk, the difference does not exceed 10% even when the reference time period $T_X$ expires.

Based on the determination as to whether or not the difference obtained by subtracting the change rate of the signal $V_G$ from that of the signal $V_A$ exceeds 10%, the control circuit 26 determines, during the heating step, which the beverage to be heated is, the saké or the milk. This determining operation will be referred to as a second food determining operation. When the difference obtained by subtracting the change rate of the signal $V_G$ from that of the signal $V_A$ exceeds 10%, the beverage to be heated is finally determined to be the saké and a remaining heating time period in the saké course is calculated (step S30). The obtained remaining heating time period is displayed on the display section 7 (step S31).

Even when the beverage to be heated is the saké, the difference obtained by subtracting the change rate of the signal $V_G$ from that of the signal $V_A$ does not sometimes exceed 10% until the reference determining time period $T_X$ expires. The reason for this is that even when the beverage to be heated is the saké, an amount of alcohol exhaling from the saké is sometimes small depending upon the condition in the heating chamber 3, the condition where the saké has been stored in a refrigerator or the like, or the configuration of the saké bottle. Thus, when determining in the negative at step S29, the control circuit 26 exceeds the heating operation on the basis of the results of the above-described first and second food determining operations in the following manner. That is, when it is determined by both first and second food determining operations that the beverage to be heated is the milk (determination in the negative at step S33), the control circuit 26 finally determines that the beverage is the milk, calculating the remaining period of the heating time period $T_b$ of the milk course (step S34) and displaying the calculated remaining period on the display section 7 (step S35). When the beverage to be heated is determined to be the saké by the first food determining operation while it is determined to be the milk by the second food determining operation (determination in the affirmative at step S33), the control circuit 26 calculates the remaining period of the predetermined intermediate course between the heating time period $T_a$ of the saké course and the heating time period $T_b$ of the milk course (step S36), displaying the obtained remaining period of the heating time period $T_c$ of the intermediate course on the display section 7 (step S37). The control circuit 26 stops oscillation of the magnetron 24 to complete the heating operation (at time $t_2$ in step S39) when the remaining period of the determined course has expired (step S38).

The following TABLE 1 shows the heating courses finally set in combination of the determinations by the first and second food determining operations.

TABLE 1

| | Determination before the heating | |
|---|---|---|
| Determination during the heating | presence of alcohol change rate >3.0% | absence of alcohol change rate ≦3.0% |
| presence of alcohol change rate >10.0% | Saké course | Saké course |
| absence of alcohol change rate ≦10.0% | Intermediate course | Milk course |

According to the above-described arrangement, the control circuit 26 determines which the beverage to be heated is, saké or milk, based on the results of determination by both the first food determining operation executed prior to the heating and the second food determining operation executed during the heating operation. Differing from the prior art arrangement wherein the beverage is determined to be either saké or milk only at a time during the heating operation, the above-described arrangement can provide reliable determination as to which the beverage is, saké or milk, regardless of the condition in the heating chamber 3, the condition where the saké has been stored in a refrigerator or the like, or the configuration of the saké bottle called "tokkuri."

The second food determining portion is continuously performed in a relatively long reference time period $T_X$ during drive of the magnetron 24. Consequently, a reliable determination of the beverage can be provided as compared with the prior art wherein the beverage is determined only at one time during the heating operation, even when the beverage to be heated has small change in its alcoholic concentration.

When the beverage to be heated is determined to be the saké by the first food determining operation while the beverage is determined to be the milk by the second food determining operation, the heating time period is set at the intermediate value between those of the saké and milk courses. Consequently, the saké can be prevented from being excessively heated even when the beverage is erroneously determined to be the milk, and insufficient heating of the milk can be prevented even when the beverage is erroneously determined to be the saké.

The reference value compared with the change rate of the signal $V_A$ generated by the alcohol sensor 13 for determination of the beverage is set for 3% before drive of the magnetron 24 and for 10% during drive of the magnetron 24. Consequently, the beverage to be heated can be more reliable determined to be either the saké or the milk.

Additionally, when determining that the saké bottle called "tokkuri" is present on the turntable 4, based on the results of detection by the photo sensors 10, the control circuit 26 then determines that the beverage to be heated is the saké, executing the saké course. Consequently, the saké course can be properly executed even when the configuration of the saké bottle considerably prevents exhalation of alcohol.

In the foregoing embodiment, the heating time period is set as a value intermediate between the heating time periods of the saké and the milk when the beverage to be heated is determined to be the saké by the first food determining operation while it is determined to be the milk by the second food determining operation. Alternatively, when determined to be the saké by either first or second food determining operation, the beverage may be finally determined to be the saké, as shown by the following TABLE 2. That is, there is a high possibility that the beverage is the saké, when the beverage is determined to be the saké by either one of the first and second food determining operations. Accordingly, the beverage is finally determined to be the saké.

TABLE 2

| | Determination before the heating | |
|---|---|---|
| Determination during the heating | presence of alcohol change rate >3.0% | absence of alcohol change rate ≦3.0% |
| presence of alcohol change rate >10.0% | Saké course | Saké course |
| absence of alcohol change rate ≦10.0% | Saké course | Milk course |

Furthermore, the change rate of the signal $V_A$ generated by the alcohol sensor 13 is compensated by the change rate of the signal $V_G$ generated by the gas sensor 14 in execution of the second food deterring operation in the foregoing embodiment. Such compensation may be provided for the first food determining operation executed before the heating operation. In this case, the accuracy of determination as to the type of food can be improved in the case where the heating operation is performed when the room temperature is relatively high. Furthermore, the invention may be applied to the case where alcoholic beverage or food other than the saké may be warmed.

The foregoing disclosure and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. A high-frequency heating apparatus comprising:

a) a heating chamber;

b) heating means for heating food accommodated in the heating chamber;

c) an alcohol sensor for detecting alcohol concentration in the heating chamber and for generating a detection signal based on the detected alcohol concentration;

d) food determining means connected to the alcohol sensor for classifying the food accommodated in the heating chamber based on the alcohol concentration detected by the alcohol sensor, the food accommodated in the heating chamber being classified as one of a first food group and a second food group, the first food group being characterized by a large alcohol concentration and the second food group being characterized by a small alcohol concentration; and e) control means connected to the heating means and the food determining means for driving the heating means for a predetermined period of time based on the classification of the food accommodated in the heating chamber;

the food determining means comprising:

first classifying means for performing a first classification of the food into the first or second food group based on the detection signal generated by the alcohol sensor after generation of a cooking start command and before the heating means is driven, the first classifying means generating a provisional classification result based on the first classification;

second classifying means for performing a second classification of the food into the first or second food group based on the detection signal generated by the alcohol sensor while the heating means is driven and subsequent to the classification by the first classifying means and for generating a second classification result based on the second classification; and difference determining means for generating a command when the provisional classification result differs from the second classification result, wherein the control means adjust the length of time the heating means is driven based on the command so that food classified in the first food group is heated for a longer length of time than food classified in the second food group.

2. A high frequency heating apparatus according to claim 1, wherein the command generated by the difference determining means is adjusted when the food has been classified into the first food group by the first classifying means so the food has been classified into the second food group by the second classifying means so that the control means adjusts the length of time the heating means is driven to a length of time which is between the length of time for food classified in the first food group and the length of time for food classified in the second food group.

3. A high frequency heating apparatus according to claim 2, wherein the food determining means finally classifies the food into the first food group when the food has been classified into the first food group by the second classifying means and the food determining means finally classifies the food into the second good group when the food has been classified into the second food group by both first and second classifying means.

4. A high frequency heating apparatus according to claim 1, wherein the food determining means finally classifies the food into the first food group when the food has been classified into the first food group by the second classifying means.

5. A high-frequency heating apparatus according to claim 1, further comprising receptacle detecting means for detecting a type of a receptacle containing the food in the heating chamber and for generating a signal based on the detected type, wherein the food determining means classifies the food based on the signal generated by the receptacle detecting means.

6. A high frequency heating apparatus according to claim 5, wherein the food determining means classifies the food based on at least one of the result of detection by the receptacle detecting means and the classification performed by the first and second classification means.

7. A high frequency heating apparatus according to claim 1, wherein the first and second classification means of the food determining means have reference values which are different from each other.

8. A high-frequency heating apparatus according to claim 1, further comprising a gas sensor for detecting steam concentrations in the heating chamber, wherein the food determining means compensates the result of detection by the alcohol sensor based on the result of detection by the gas sensor.

* * * * *